United States Patent [19]

Braun et al.

[11] 4,405,054

[45] Sep. 20, 1983

[54] CONTAINER INCLUDING PRESSURE MOUNTED INNER COVER

[75] Inventors: Morris Braun, Chicago; Karen A. Wavering, Villa Park, both of Ill.

[73] Assignee: W. Braun Co., Chicago, Ill.

[21] Appl. No.: 358,094

[22] Filed: Mar. 15, 1982

Related U.S. Application Data

[63] Continuation of Ser. No. 152,334, May 22, 1980, abandoned.

[51] Int. Cl.[3] ..... B65D 51/18

[52] U.S. Cl. ..... 215/277; 215/341; 220/256

[58] Field of Search ..... 215/277, 270, 341; 220/256

[56] References Cited

U.S. PATENT DOCUMENTS

| | | | |
|---|---|---|---|
| 911,380 | 2/1909 | Comings | 215/361 |
| 2,985,354 | 5/1961 | Aldington | 220/307 X |
| 3,244,308 | 4/1966 | Esposito | 215/270 |

FOREIGN PATENT DOCUMENTS

| | | | |
|---|---|---|---|
| 84814 | 5/1958 | Denmark | 215/277 |
| 1205887 | 9/1970 | United Kingdom | 215/341 |

*Primary Examiner*—Donald F. Norton

*Attorney, Agent, or Firm*—Kegan, Kegan & Berkman

[57] ABSTRACT

A container for a cream, gel, or the like, includes a bottle or jar, a top or primary cap, and a secondary or inner cover which is positioned over a top opening in the jar and compressed into sealing engagement therewith by the closure of the cap on the jar. The inner cover includes a resilient frusto-conical wall portion positioned between an outer rim a central hub. As the cap is threaded onto the jar, a top wall of the cap engages and depresses the hub of the inner cover, and flattens the frusto-conical wall which then exerts radially outward pressure on the rim to sealingly engage same with lip on the opening of the jar.

1 Claim, 5 Drawing Figures

CONTAINER INCLUDING PRESSURE MOUNTED INNER COVER

This is a continuation of application Ser. No. 152,334, filed May 22, 1980, now abandoned.

BACKGROUND OF THE INVENTION

This invention relates generally to jar or bottle type containers, and more particularly to the combination of a jar, a cap which screws onto an open top of the jar, and a sealing or inner cover positioned between the open top and cap.

Heretofore, certain jars or bottles have included a secondary cover for enclosing the top of a jar or bottle even when the cap of such a container is off its mounting. Such inner or secondary covers are likely to be used when the jar or bottle contains matter which may deteriorate with prolonged contact with the air. Known secondary covers have been made of cardboard, plastic, wax paper or the like. In some instances, the covers have been adhesively retained on the lip of a jar or bottle mouth, and in other instances the cover merely sets loosely on the lip and is forced into sealing engagement by tightening the cap on the jar. While the covers which adhere to the lip of the jar provide sufficient initial sealing characteristics, removal of the inner cover from the jar lip typically breaks the seal in a permanent manner. One example of such a secondary cover may be found in containers for freeze-dried coffee. Additional containers having inner covers which provide sealing engagement have been formed in a cup-shape having an outer wall which is capable of being press fit into the mouth of a jar or bottle. Such covers may be found on containers for volatile chemicals such as cleaning fluids. While such covers provide a sealing engagement when the cap is off the jar, they are difficult to remove from the lip of the jar. Therefore, a need has arisen for a jar or bottle type container having an inner cover which is adapted to provide a sealing engagement with the lip or mouth of the jar portion thereof while being stably mounted thereon in the absence of the outer cap. Such a cover should also provide for ease of removability from the container while being reusable when the container is closed after use.

BRIEF SUMMARY OF THE INVENTION

It is therefore an object of the present invention, generally stated, to provide an improved jar or bottle type container including an inner sealing cover therefore.

Another object of the present invention is the provision of an improved inner sealing cover for a container wherein the cover provides for stable mounting on an open top of the container, is easy to remove and replace when access is desired to materials in the container, and yet sealingly and resealingly engages the mouth of the container when an outer cap is closed thereon.

The invention is directed to a container including a bottle or jar portion having a curved sidewall and an integral bottom enclosing wall. The sidewall has an annular lip at the top thereof and means adjacent the lip for securing the closure cap to it. A closure cap for the container has a curved sidewall including an annular lip at the bottom thereof and means adjacent the lip for securing the cap to the jar portion. A sealing cover for the container includes an annular outer rim portion, a web portion and a hub portion. The outer rim portion includes means for engaging the jar lip, the web portion defines a resilient generally frusto-conical wall, and the hub portion encloses the frusto-conical portion and includes a top wall. The closure cap, as mounted on the jar portion, is dimensioned to axially compress the hub and web portions which pushes the rim portion into substantial sealing engagement with the jar portion.

DETAILED DESCRIPTION OF PREFERRED EMBODIMENT

Figure 1:
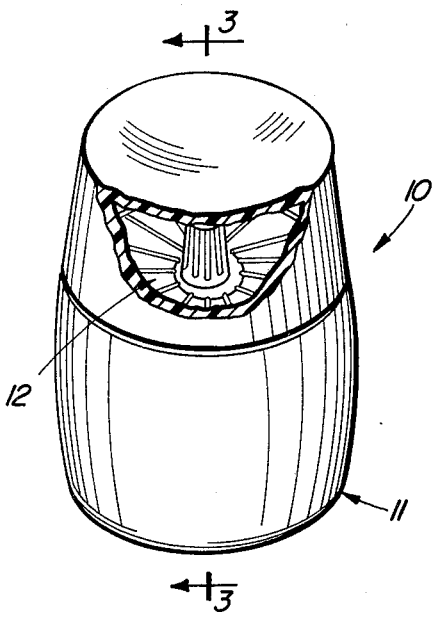
FIG. 1 is a perspective view, with portions cut away, of the jar-type container of the present invention.

Referring to FIGS. 1–5, a container 10, constructed in accordance with the present invention, includes a bottom jar or bottle portion 11, a secondary sealing cover 12 mounted across the top of jar 11, and a closure cap 13 which is threadedly retained on the top of jar or bottle 11.

While the jar 11 may be of any convenient shape or design, in this embodiment the jar is defined by a generally cylindrical although slightly curved sidewall 14, a slightly concave bottom surface 15 which encloses the bottom of sidewall 14, an annular externally threaded portion 16 extending upwardly from sidewall 14 including an external thread 17 therearound, and an annular upper lip portion generally indicated at 18, defining the open top or mouth of jar 11. The upper lip portion 18 includes a flat top surface 20, and inner and outer generally cylindrical side surfaces 21, 22, respectively.

The top closure cap, in this embodiment, includes a generally cylindrical although slightly tapered sidewall 23, a slightly concave top wall 24*a* which encloses the upper portion of sidewall 23, a generally flat annular bottom surface 24*a*, an internally threaded portion 25 positioned inwardly adjacent bottom surface 24 and including internal thread 26 thereon, and a resilient annular wiping seal 27 positioned immediately superjacent the internally threaded portion 25 and extending around the inner surface of cap sidewall 23. The internal thread 26 is sized to matingly engage the external thread 17 on the jar portion so as to closingly engage the cap over the mouth of the jar.

An important aspect of the present invention resides in the secondary sealing cover 12 which in this embodiment, includes a generally cylindrical hub or finger gripping portion 30 having a top wall 31 enclosing the upper end of same. A shallow frusto-conical web 32 extends generally radially outwardly from the bottom of finger gripping portion 30, and an annular rim portion 33 is positioned integrally radially outwardly of the outer end of the web 32. In this embodiment the finger gripping portion 30 includes a plurality of axially oriented ribs 34–34 which provide a textured grasping surface and also strenghten the characteristics of the portion against axial compression. At the junction of the finger gripping portion 30 and web 32 is a resilient annular flute, trough or concave curved wall portion 35 which allows movement of the web 32 relative the finger gripping portion 30. Web 32 also includes a plurality of radially extending flutes or troughs 36–36 which also provide for resilient movement of segment the web 32 relative one another. At the juncture of the web 32 and rim 33 is a large annular flute or trough 37 which further allows resilient movement between the web 32 and rim 33. The combination and inter-connection of the annular trough 35 the radially extending troughs 36–36 and large annular trough 37 provide the web portion 32 with substantial resilient qualities relative the rim 33 and finger gripping portion 30. The benefit derived from these added resilient qualities aids in sealing the secondary cover to the jar, The outer rim 33 of the secondary cover 12 includes an annular generally axially oriented wall 38 extending annular distal wall 40 which projects from the top of wall 38.

Figure 3:
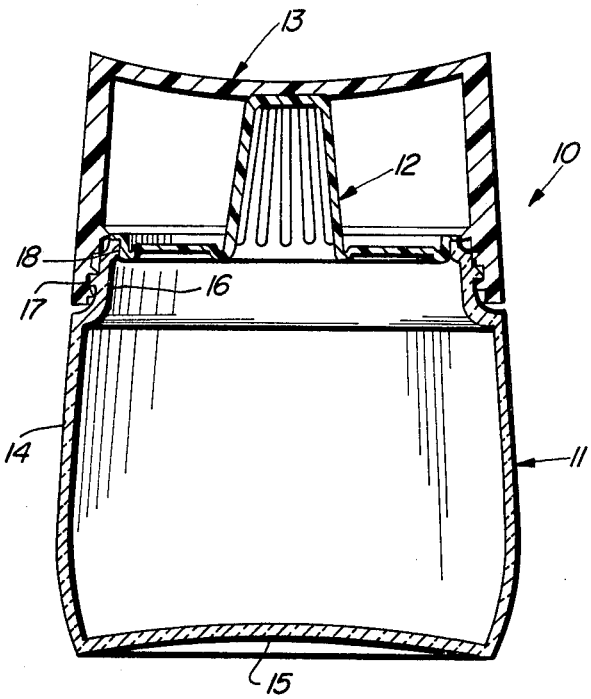
FIG. 3 is a vertical cross-section view, on enlarged scale, taken along line 3—3 of FIG. 1.
Figure 2:
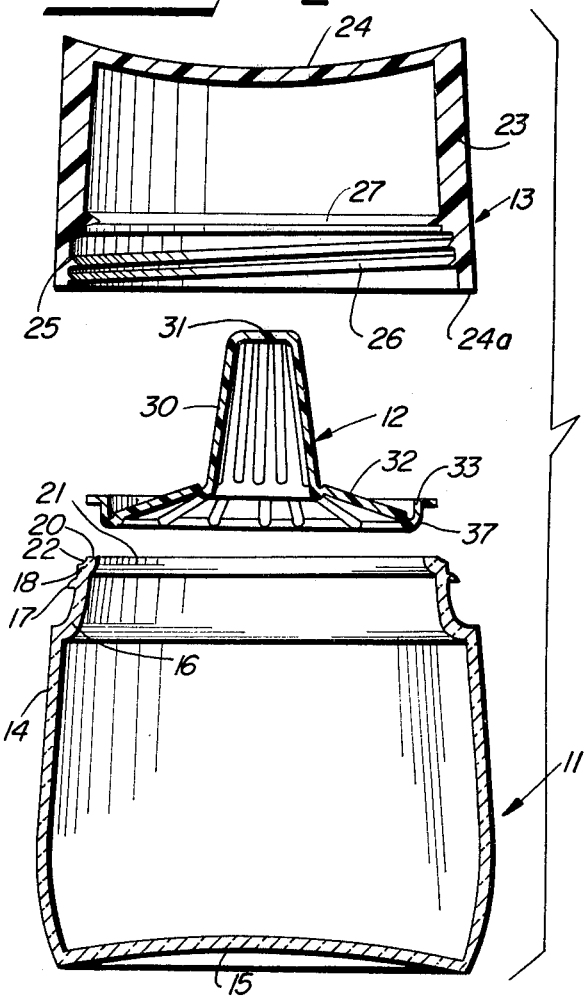
FIG. 2 is an exploded cross-section view, on enlarged scale, of the container shown in FIG. 1 taken substantially along line 3—3 of FIG. 1.
Figure 4:
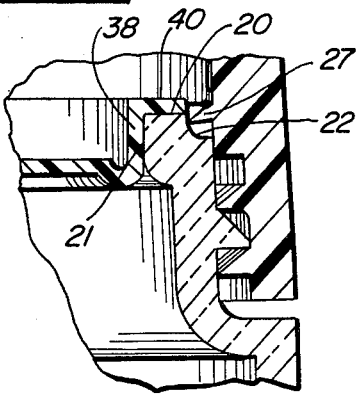
FIG. 4 is a detailed fragmentary cross-section view, on enlarged scale, of the juncture between the jar, cover, and cap shown in FIG. 3.
Figure 5:
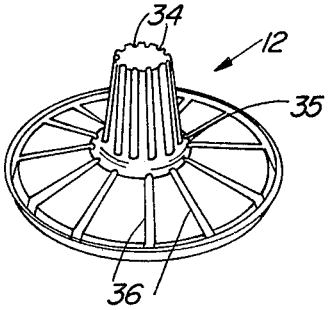
FIG. 5 is a detail perspective view of the secondary sealing cover of the present invention.

As shown most clearly in FIGS. 2, 3 and 4, the closure of cap 13 on jar 11, with cover 12 in place, moves the cover into sealing engagement with the mouth or lip 18 of the container. Prior to mounting the closure cap 13 on jar 11, the sealing cover 12 has the unstressed shape shown in FIG. 2 with the radially extending wall 40 of rim 33 matingly engaging the top wall 20 of the lip 18 on the jar, and the axially extending wall 38 of rim 33 matingly engaging the inner wall 21 of lip 18. As the cap is turned or threaded midway onto the jar 11, the inner surface of top wall 24 on the cap engages the hub 30 of the sealing cover 12. As the turning of cap 13 on jar 11 continues, the top wall 24 of the cap pushes the hub 30 axially downwardly relative the rim 33 of the sealing cover 12. The resilient ribs or troughs of the web portion 32 on cover 12 allow the web to flatten from the position shown in FIG. 3 as the cap moves into locking engagement with the jar. The flattening of web 32 exerts outward radial forces onto the rim 33 of the cover, expanding same and providing substantial sealing engagement between the mating vertical wall surfaces 38 of rim 33, and 21 of lip 18. The downward pressure of cap 13 on hub 30 is transferred in part to the radially extending wall 40 on rim 33 which sealingly engages the upper surface 20 of lip 18. An additional advantage of the present invention is that the absence of adhesive materials in the sealing cover 12 allows the container to be reopened and resealed in a non-destructive manner.

While a particular embodiment of the invention has been shown and described, it will be obvious to those skilled in the art that changes and modifications may be made without departing from the invention in its broader aspects. Therefore, the aim in the appended claims is to cover such changes and modifications as fall within the true spirit and scope of the invention.

The invention is claimed as follows:

1. An improved double seal container comprising:

a bottle or jar portion including a circumferentially curved first side wall and an integral bottom enclosing wall; said first side wall including a first annular lip at the top thereof and means on an outer portion of said first side wall subjacent said lip for securing a closure cap thereto;

said first lip including a top surface being substantially horizontal, an inner vertical surface, an outer generally vertical annular surface extending generally downwardly from an outer edge to said top surface toward said closure cap securing means;

a closure cap having a curved second side wall including a second annular lip at the bottom thereof and an integral top enclosing wall, means on an inner portion of said second side wall substantially immediately above said lip for matingly securing said cap to said jar portion securing means, and an annular wiping seal positioned inwardly adjacent and above said securing means for providing a first sealing engagement between said closure cap and said outer annular surface of said first lip thereof when said cap is closed thereon;

a one-piece sealing cover including an annular outer rim portion, a web portion, and a hub portion, all of substantially constant cross-sectional thickness, said outer rim portion including a radially extending wall for resting on top of said lip top surface of said jar and an axially oriented cylindrical wall extending downwardly from an inner edge of said radial wall for engaging said inner surface;

said web portion defining a generally frusto-conical wall with an inner boundary thereof joining said hub portion at a bottom thereof and an outer boundary thereof defining a resilient annular trough joining said axially oriented cylindrical wall at a bottom thereof;

said hub portion including a top wall and a generally cylindrical wall extending axially between said top wall and said web portion, said generally cylindrical wall including a surface thereon suitable for grasping retention by a user of said container when removing said cover from said jar portion annular lip and when positioning said cover on said jar portion annular lip, said closure cap top wall including an inner surface having a central portion thereof which is adapted, when mounted on said jar portion, to press on said hub portion, deform said web portion, and move said outer rim portion thereof into a second sealing engagement with said jar lip defining a continuous two surface annular engagement between said outer rim portion and said jar lip, said engagement surfaces being L-shape in vertical cross section and positioned for engagement independently of said first sealing engagement, and a first perpendicular distance between said inner surface central portion and said annular wiping seal being less than a second perpendicular distance between said top wall of said hub and said radially extending wall of said outer rim portion when said sealing cover web portion is undeformed and greater than said second perpendicular distance when said sealing cover web portion is deformed.

* * * * *